United States Patent [19]

Taylor

[11] Patent Number: 5,014,587

[45] Date of Patent: May 14, 1991

[54] ELECTRONIC PIANO TONE CIRCUIT

[75] Inventor: William R. Taylor, Williamsville, N.Y.

[73] Assignee: The Quaker Oats Company, Chicago, Ill.

[21] Appl. No.: 421,775

[22] Filed: Oct. 16, 1989

[51] Int. Cl.[5] ..... G10H 1/20; G10H 1/32; G10H 5/12

[52] U.S. Cl. ..... 84/659; 84/670; 84/718

[58] Field of Search ..... 84/627, 670, 659–661, 84/702, 718, 735, 738, 743; 307/227, 246, 473

[56] References Cited

U.S. PATENT DOCUMENTS

| | | | |
|---|---|---|---|
| 2,547,759 | 4/1951 | Kent | 84/697 |
| 2,557,769 | 6/1951 | Schmidt | 84/692 |
| 3,602,628 | 8/1971 | Peterson | 84/687 |
| 3,746,775 | 7/1973 | Uchiyama | 84/702 X |
| 3,832,576 | 8/1974 | Proebsting | 307/473 |
| 3,848,142 | 11/1974 | Adachi | 84/702 X |
| 3,935,783 | 2/1976 | Machanian | 84/698 |
| 3,937,115 | 2/1976 | Staley | 84/675 |
| 4,095,502 | 6/1978 | Moore | 84/687 |
| 4,129,056 | 12/1978 | Jensen | 84/687 |
| 4,135,425 | 1/1979 | Doane | 84/702 |
| 4,186,642 | 2/1980 | Grass | 84/702 X |
| 4,397,211 | 8/1983 | Ferdinand | 84/702 |
| 4,417,496 | 11/1983 | Machanian | 84/663 |
| 4,567,806 | 2/1986 | Kodaira | 84/663 |
| 4,638,710 | 1/1987 | Kitamura | 84/607 |
| 4,683,795 | 8/1987 | Kitamura | 84/607 |

*Primary Examiner*—William M. Shoop, Jr.
*Assistant Examiner*—B. Sircus
*Attorney, Agent, or Firm*—Cumpston & Shaw

[57] ABSTRACT

Apparatus for generating an enveloped tone signal includes a digital portion for generating an alternating logical wave form at the desired frequency, and a start pulse for initiating the tone; and an analog portion responsive to the alternating logical wave form and the start pulse for creating the tone, the analog portion including a capacitor responsive to the start pulse for storing a charge and a switching device connected to the capacitor and responsive to the alternating logical wave form for repeatedly bleeding off a portion of the charge from the capacitor in synchronization with the alternating logical wave form, and a transducer connected to the capacitor for producing the enveloped tone signal.

22 Claims, 4 Drawing Sheets

ELECTRONIC PIANO TONE CIRCUIT

This invention relates in general to electronic tone generating circuits, and more particularly to a circuit having a particularly convenient interface between a digital portion and an analog portion, and even more particularly to a reduced pin count circuit for generating a decaying envelope tone, such as a tone representing the striking of a piano key.

Tone generating circuits for use in low cost musical toys commonly employ digital circuitry for generating square wave music signals, and digital control signals, for controlling the frequency and initiation of a tone; combined with analog circuitry responsive to the two digital signals for producing an enveloped tone at a speaker or the like. It will be appreciated that tone generating circuits that combine digital and analog portions may have a lower parts count, and accordingly lower total cost than circuits that attempt to provide an all digital tone generating circuit. Although hybrid digital/analog circuitry can be fabricated that combines the digital and analog components necessary to create an enveloped music signal on a single chip, hybrid circuitry is significantly more expensive than purely digital circuitry.

In applications where the use of custom circuitry is warranted by the high number of units to be produced, cost becomes of paramount concern.

Accordingly, it is an object of this invention to provide a tone generating circuit that has a purely digital portion that may be integrated at very low cost, and an analog circuit portion that may be conveniently interfaced to the digital circuit for producing an enveloped tone.

It is another object of this invention to provide apparatus for generating an enveloped tone signal comprising a digital portion for generating an alternating logical wave form at the desired frequency, and a start pulse for initiating the tone; and an analog portion responsive to the alternating logical wave form and the start pulse for creating the tone, the analog portion including storage means responsive to the start pulse for storing a charge and switching means connected to the storage means and responsive to the alternating logical wave form or repeatedly bleeding off a portion of the charge from the storage means in synchronization with the alternating logical wave form, and a transducer connected to the storage means for producing the enveloped tone signal.

It is still another object of this invention to provide apparatus for generating an enveloped tone signal requiring fewer connections between a digital portion thereof and an analog portion thereof than has been possible heretofore, and including storage means having an input terminal and responsive to a logical ON signal at said terminal for storing a charge, and responsive to an alternating logical OFF and high impedence signal for producing an enveloped tone signal at the input terminal; and digital tone control means having a control output connected to said input terminal of the storage means, a trigger input and a sound input. The tone control means are responsive to a start signal applied to said trigger input, and a sound signal applied, to said sound input for producing a logical on signal in response to said start signal, and an alternating logical low and high impedence signal in response to said sound signal.

It is another object of this invention to provide apparatus as described above, in which the tone control means comprises a tri-state digital device having a gate terminal connected to the sound input, an input terminal connected to the trigger input, and an output terminal connected to the control output of the tone control means.

It is yet another object of this invention to provide tone control apparatus of the type described and further including click suppression means comprising an AND gate having an output connected to the input terminal of the tri-state device, an OR gate having an output connected to the gate terminal of the tri-state device, said AND gate and said OR gate each having first and second inputs, and first inputs connected in parallel to said sound input, and the second inputs connected in parallel to the trigger input.

It is a further object of this invention to provide apparatus of the type described above in which the storage means comprises a capacitor. It is a still further object of this invention to provide tone control apparatus in which the storage means comprises a diode in series relationship with the capacitor, and further comprising a resistor in parallel circuit relationship with the diode.

It is yet a further object of this invention to provide tone control apparatus of the type described, further including amplifier means connected to the input terminal of the storage means, and a speaker connected to the amplifier means.

While the novel aspects of the invention are set forth with particularity in the appended claims, the invention itself, together with further objects and advantages thereof may be more readily understood by reference to the following detailed description of the invention, taken in conjunction with the accompanying drawings in which:

Figure 1:
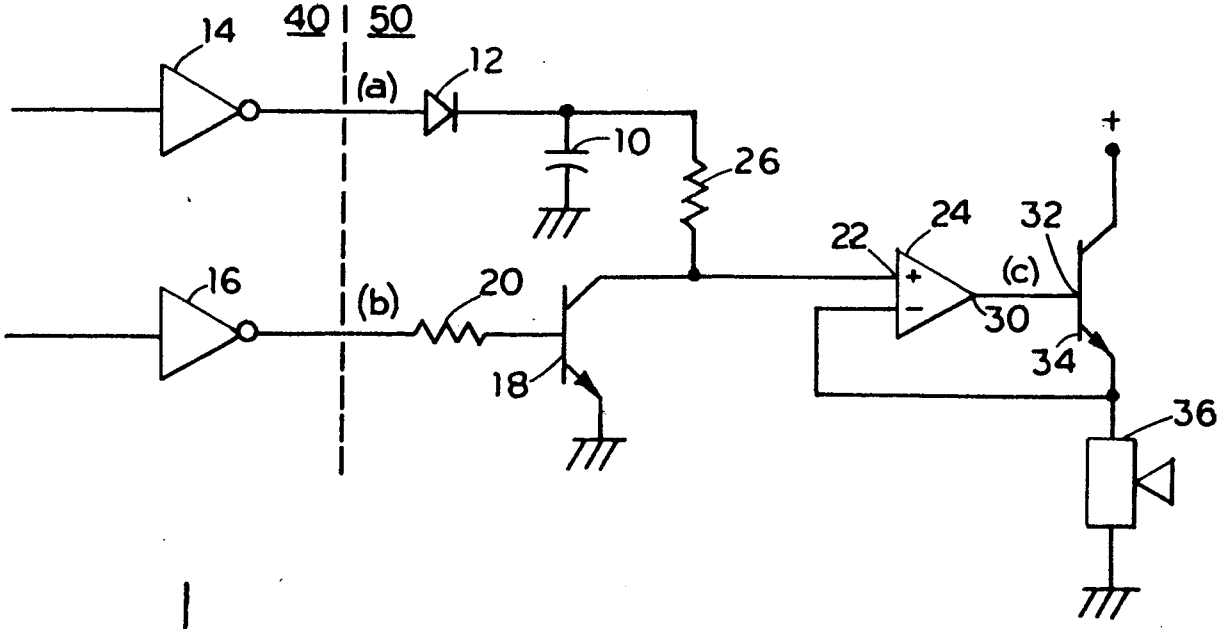
FIG. 1 is a schematic diagram of an enveloped tone generating circuit in accordance with this invention.
Figure 2:
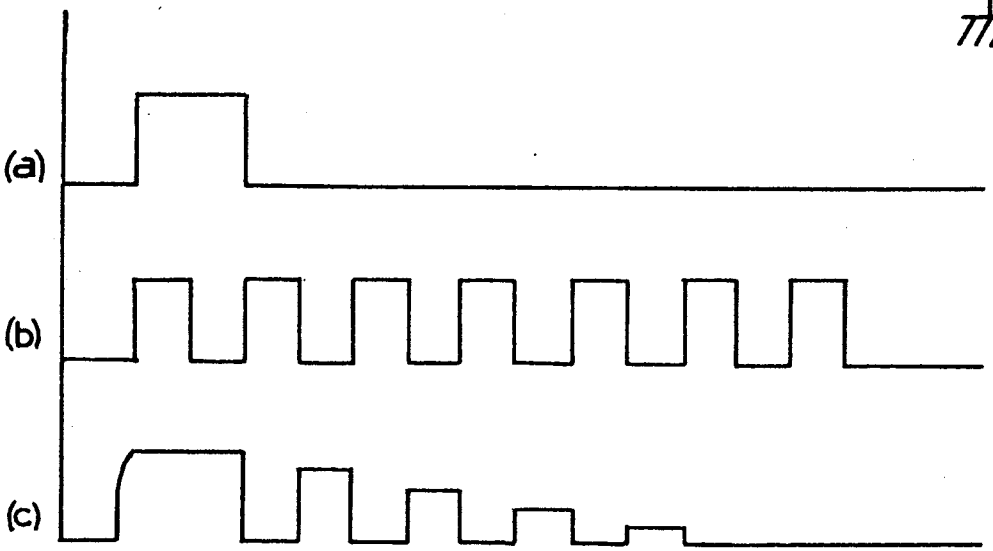
FIG. 2 is a wave form diagram of various signals appearing in the apparatus of FIG. 1.

Referring now to FIGS. 1 and 2, a tone control circuit in accordance with the invention is illustrated in schematic form. A capacitor 10 is charged through a diode 12 in response to a positive going logic level pulse from a gate 14 in the digital portion of the current as illustrated at FIG. 2(*a*). An oscillating, preferably about 50% duty cycle square wave logic level signal (b) is applied from a gate 16 through a current limiting resistor 20 to the base of a switching transistor 18, alternately driving the transistor between an off state and conduction, repeatedly shorting the non-inverting input 22 of operational amplifier 24 to ground, and simultaneously grounding capacitor 10 through resistor 26.

Each time resistor 26 is grounded, the voltage on capacitor 10 is reduced in accordance with the RC time constant of the combination of capacitor 10 and resistor 26, thereby producing a decaying envelope output signal (c) at output 30 of operational amplifier 24. Output 30 is connected to the base 32 of a driver transistor 34, which drives speaker 36 in a conventional emitter follower configuration to produce an enveloped tone output corresponding essentially to wave form (c).

FIG. 2 shows wave form diagrams of the voltages appearing at (a), (b), and (c) of FIG. 1. In each case, the voltages at (a) and (b) vary between a logic low level which may be presumed to be zero, but which in fact may be slightly higher, and a logic high level which is conventionally 5 volts, 9 volts, or higher, depending upon the type of digital circuitry employed. The wave form shown at (c) varies relatively smoothly in steps between a logic high level and a logic low level, to produce an enveloped tone.

While the circuit of FIG. 1 produces a relatively satisfactory enveloped tone signal, it suffers from the disadvantage that the interface between the digital portion of the circuit indicated generally at 40 and the analog portion indicated generally at 50 includes two connections per tone. Where multiple tone generators are employed, so as to produce a multi-voice sound, the number of pins required to interface the digital device with the analog circuit components increases to the point where the cost rises undesirably.

Figure 3:
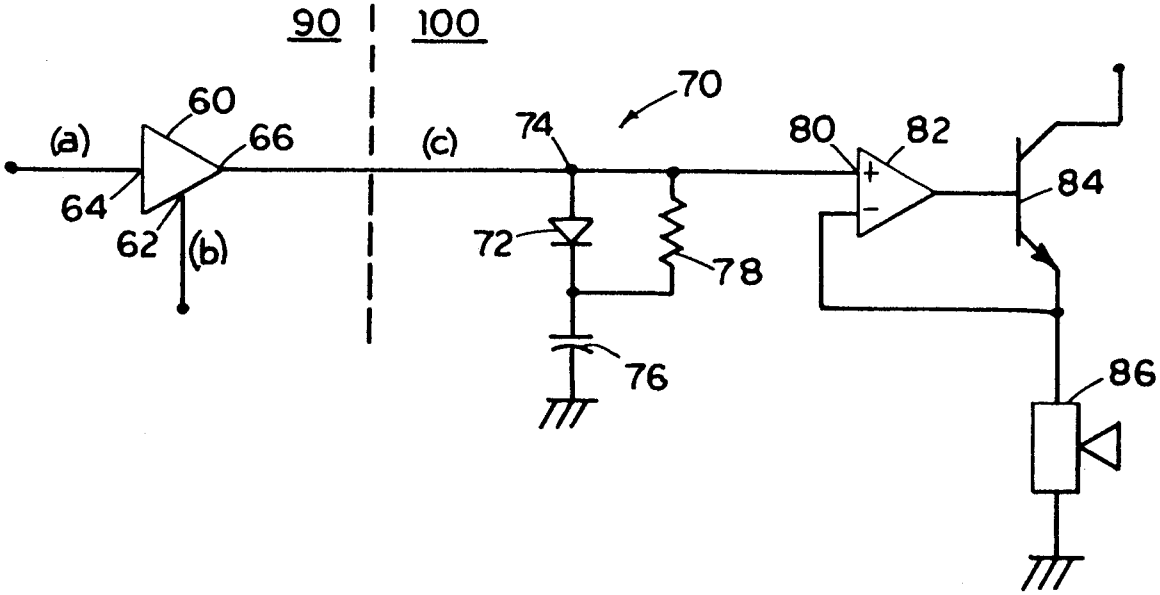
FIG. 3 is a schematic diagram of an enveloped tone generating circuit in accordance with a reduced pin count embodiment of this invention.

Referring now to FIG. 3, an enveloped tone control circuit in accordance with a reduced pin count embodiment of this invention is illustrated. A tri-state buffer 60 has a control input or gate 62, and an input terminal 64. Tri-state buffer 60 further has an output terminal 66 connected to storage means indicated generally at 70. Input 64 is adapted to receive a logical start pulse as illustrated at (a) of FIG. 4. Gate or trigger input 62 is adapted to receive a preferably 50% duty cycle, square wave sound signal as exemplified by the wave form shown at (b) of FIG. 4, and having a frequency equal to the fundamental frequency of the tone desired to be produced.

Figure 4:
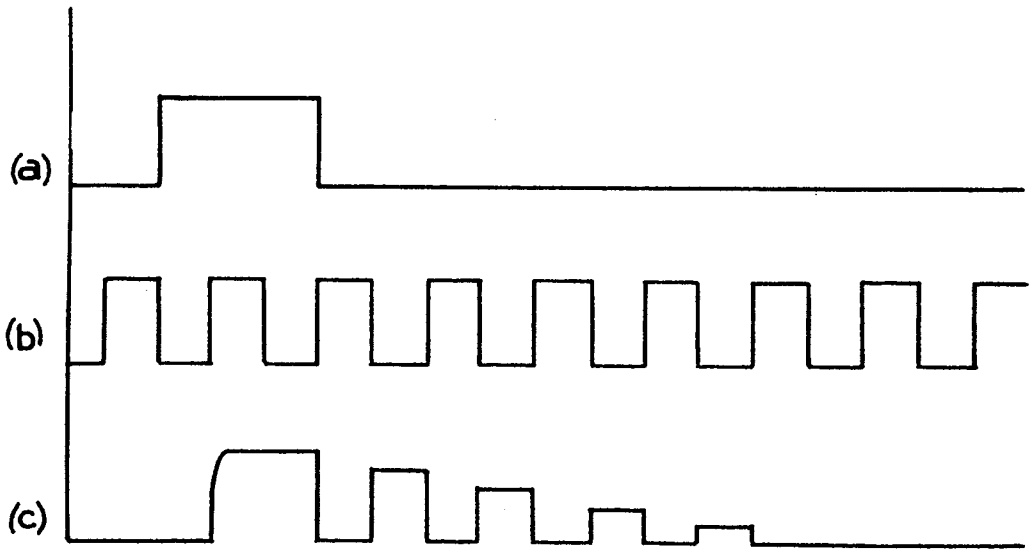
FIG. 4 is a wave form diagram of various signals appearing in the apparatus of FIG. 3.

Tri-state buffers per se are well known, and their operation is relatively well understood by those skilled in the art. When a logical high signal is applied to gate terminal 62, the logical signal applied to input 64 appears at output 66. When gate 62 is turned off by the application of a logic low signal, a high impedence is presented at output 66. As shown in FIG. 4, a positive, going start pulse is provided at input 64, and is preferably selected to have a duration at least equal to several cycles of the sound signal (b) and be in the range of 10 to 50 milliseconds long, more preferably about 30 to 50 milliseconds. This will ensure that the sound signal is high during at least a portion of the start pulse, and that the capacitor is fully charged. The sound signal (b) need not be continuous, but should commence prior to or during the time that the start pulse is high, and continue at least slightly longer than the length of the enveloped tone signal.

The storage means 70 includes a small signal diode 72, having its anode connected to an input node 74, and its cathode connected to a capacitor 76, which is also connected to ground. A resistor 78 is connected in parallel circuit relationship with diode 72. When output 66 is high, the voltage at (c) is equal to the logic high level, which may be 5 or 9 volts, or such other voltage as is produced by the type of logic employed in the device. Capacitor 76 is charged to this voltage, less the diode drop, and maintains this level until discharged. After the termination of the start pulse, the alternating sound signal (b) alternately applies a logic zero level, and a high impedence to node 74. During the time that sound signal (b) is at a logical zero level, input 80 of operational amplifier 82 is held at or near ground, and simultaneously capacitor 76 is discharged through resistor 78 at a rate determined by the time constant of the combination of the resistor and capacitor. Preferably, the time constant is selected to produce an envelope representing the desired sound such as the note produced by a conventional piano. While a wide range of resistors and capacitors may be employed, the combination of a 100K ohm resistor and a 3.3 microfarad capacitor provides a pleasing effect.

Operational amplifier 82 is connected in feedback circuit relationship with a driver transistor 84, to which a conventional speaker or other sound producing transducer is connected in emitter follower circuit relationship. The wave form (c) applied to input 80 of operational amplifier 82 is substantially reproduced at speaker 86, thereby providing the desired enveloped tone.

The circuit illustrated in FIG. 3 produces an enveloped tone substantially identical to the tone produced by the circuit of FIG. 1, but requires only a single connection between the digital portion of the circuit 90 and the analog portion 100. This provides a 50% reduction in the number of pins required to interface the digital and analog portions, a significant advantage.

While the apparatus shown in FIG. 3 provides a satisfactory enveloped tone it has been discovered that under certain circumstances related to the timing of the start pulse and lack of synchronization with the tone signal, audible clicks may be produced. In addition, the enveloped tone does not begin until the end of the start pulse. To remedy this, the arrangement shown in FIG. 5 includes an and gate 102 and an or gate 104 connected to tri-state buffer 60. AND gate 102 includes first and second inputs 106 and 108, while OR gate 104 includes first and second inputs 110 and 112. Each of the first inputs is connected to trigger input (a), while each of the second inputs is connected to sound input (b). The output 114 of AND gate 102 is connected to input 64 of tri-state buffer 60, while the output 116 of OR gate 104 is connected to gate 62 of tri-state buffer 60. The wave forms present at (a), (b), (c), (d), (e), are shown in FIG. 6.

Figure 5:
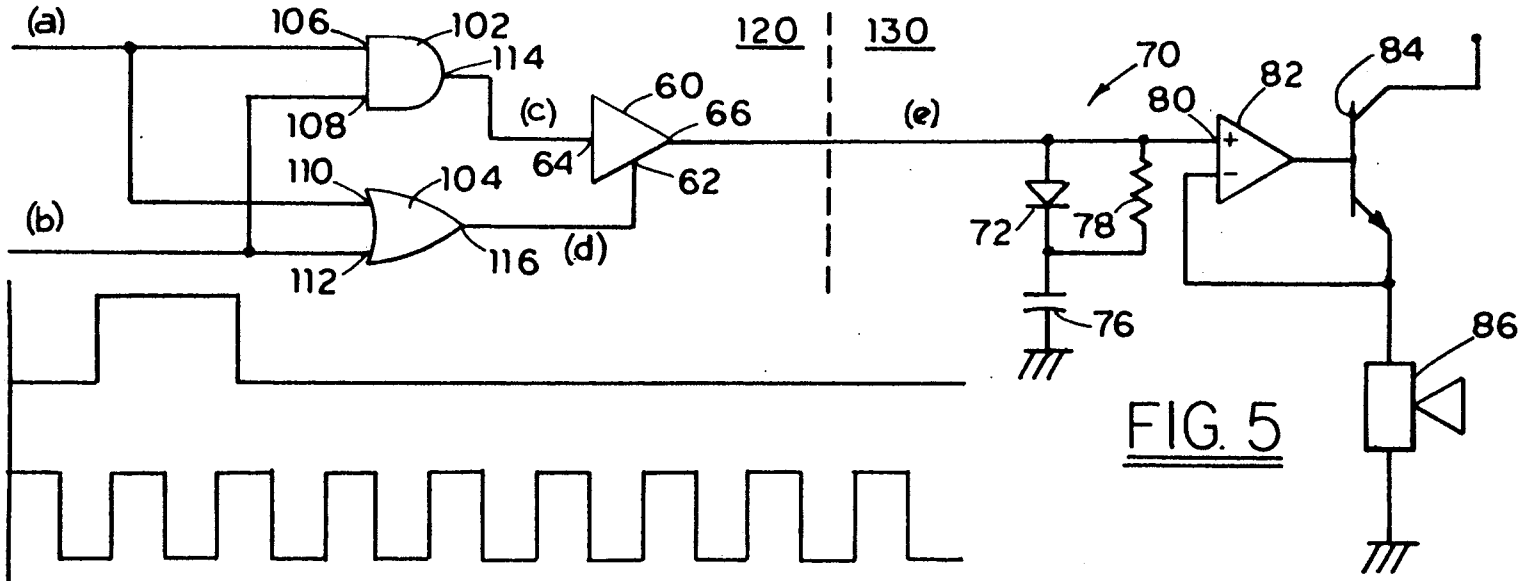
FIG. 5 is a schematic diagram of an enveloped tone control circuit in accordance with this invention, and further including click suppression circuitry.
Figure 6:
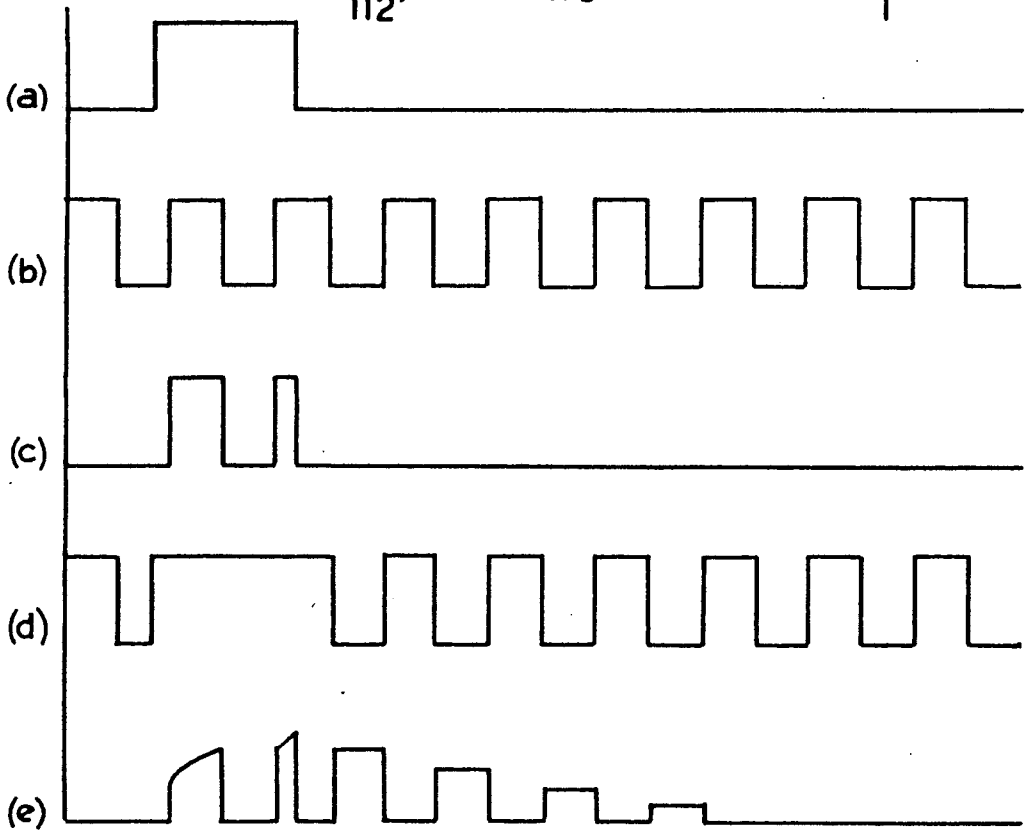
FIG. 6 is a wave form diagram of various signals appearing in the apparatus of FIG. 5.

The analog portion 130 of the tone generating circuit of FIG. 5 is identical to that already described in connection with FIG. 3.

Figure 7:
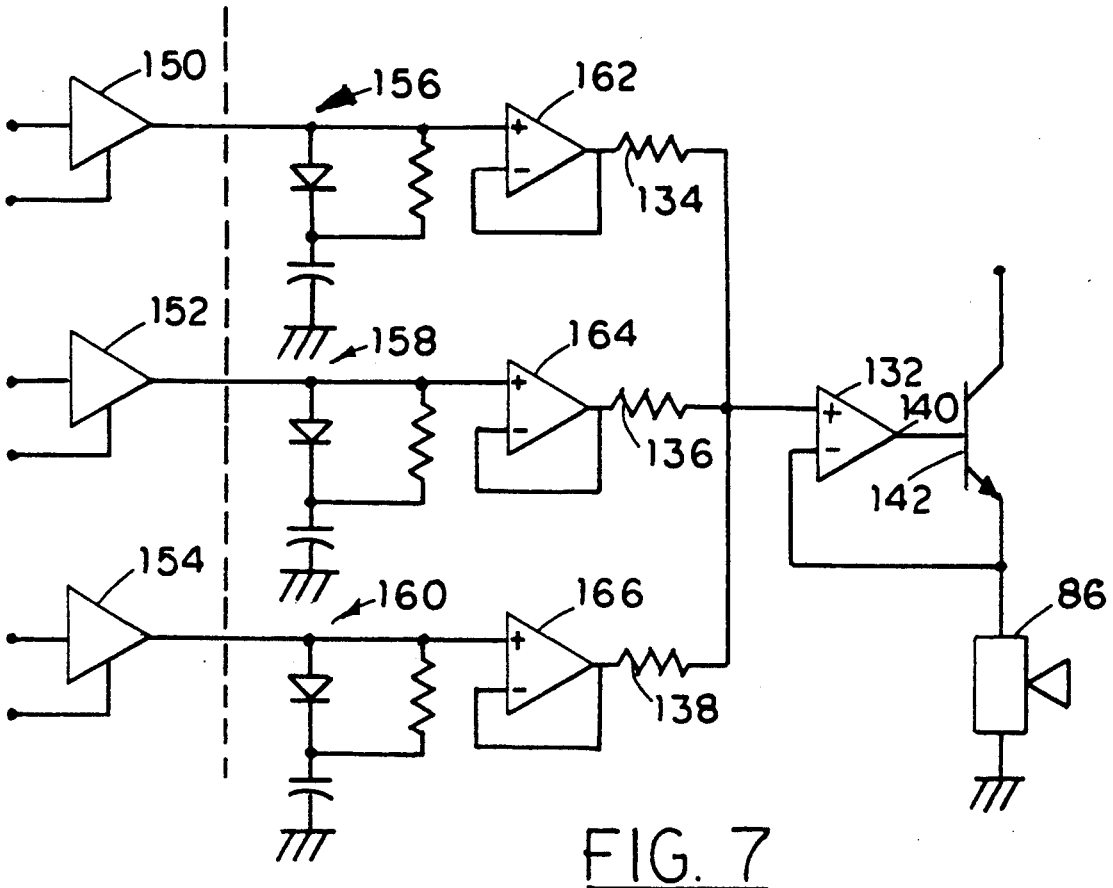
FIG. 7 is a schematic diagram of a multi-voice enveloped tone control circuit in accordance with this invention.

A tone generating circuit in accordance with this invention is particularly well adapted to be used in a multi-voice arrangement, as illustrated in FIG. 7. Three substantially identical enveloped tone control circuits of the type shown and described in connection with FIGS. 3 and 4 are connected in parallel to a summing amplifier 132 by resistors 134, 136, and 138. Summing amplifier 132 has an output 140 connected to a driver transistor 142, to which a speaker 86 is connected in emitter follower circuit relationship. Tri-state buffers 150, 152, and 154 have their outputs connected to storage circuits 156, 158 and 160 respectively, by single connections at the analog to digital interface. The storage circuits are connected to operational amplifiers 162, 164, and 166, which are connected in conventional feedback circuit fashion to provide a high impedence input and a low impedence output.

Figure 8:
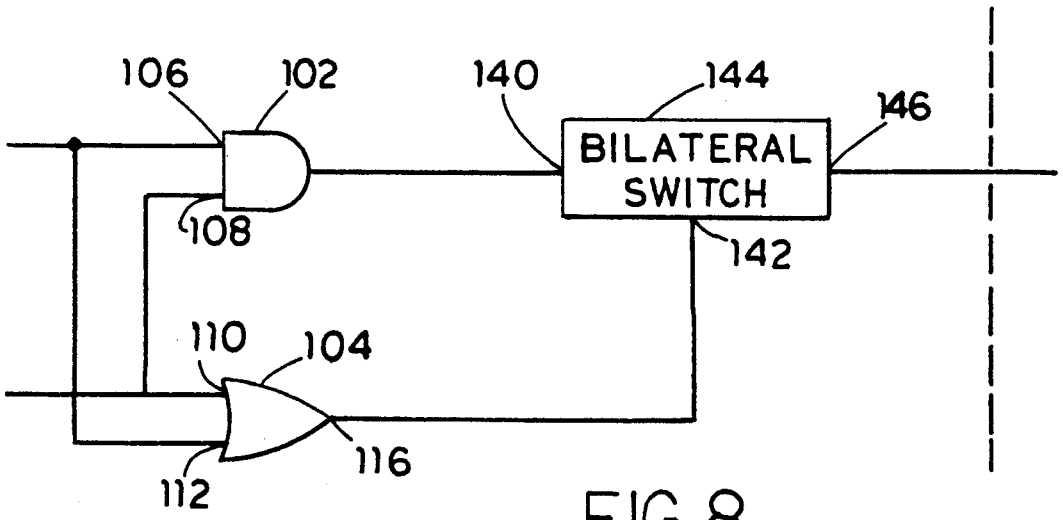
FIG. 8 is a schematic diagram of the digital portion of an alternative embodiment of the invention.

While any one of a number of well known types of tri-state buffers may be employed in a circuit in accordance with this invention, other circuit arrangements for producing substantially equivalent outputs may also be employed. For example, FIG. 8 shows the digital portion only of a tone control circuit employing a bilateral switch, such as an RCA CD 4066B quad bilateral switch. AND gate 102 and OR gate 104 are connected to the signal input 140, and control input 142 of bilateral switch 144, which has its signal output 146 available to be connected to the analog portion of a tone generating circuit as has already been described, and which is not included in FIG. 8. Bilateral switch 144 produces the same three states at output 146 as does tri-state buffer 60. It will also be appreciated that discrete implementations of bilateral switches may also be employed.

While the invention has been described in connection with a presently preferred embodiment thereof, those skilled in the art will recognize that many modifications and changes may be made without departing from the true spirit and scope thereof, which is accordingly intended to be proscribed solely by the annexed claims.

What is claimed is:

1. Apparatus for generating an enveloped tone signal comprising:

storage means having an input terminal and responsive to a logical on signal at said input terminal for storing a charge and responsive to an alternating logical off and high impedance signal for producing an enveloped tone signal at said input terminal; and tri-state tone control means have a tri-state output connected to said input terminal, a logic input and a gate input, said tone control means responsive to a start signal applied to said logic input and a sound signal applied to said gate input for producing a logical on signal in response to said start signal and an alternating logical low and high impedance signal in response to said sound signal.

2. The apparatus of claim 1 further comprising click suppression means connected to said logic input and said gate input.

3. The apparatus of claim 2 wherein said click suppression means comprises an AND gate having an output connected to said logic input terminal of said tri-state device, an OR gate having an output connected to said gate input, said AND gate and said OR gate each having a first input and a second input, each of said first inputs connected to said gate input, and each of said second inputs connected to said logic input.

4. The apparatus of claim 1 wherein said storage means comprises a capacitor.

5. The apparatus of claim 4 wherein said storage means comprises a diode in series circuit relationship with said capacitor.

6. The apparatus of claim 5 wherein said storage means also comprises a resistor in parallel circuit relationship with said diode.

7. The apparatus of claim 1 further comprising amplifier means connected to said input terminal of said storage means; and speaker means connected to said amplifier means.

8. The apparatus of claim 7 in which said amplifier means comprises operational amplifier means and driver transistor means connected between said storage means and said speaker means.

9. Tone generating apparatus comprising:

digital circuit means for generating a digital pulse stream and a start pulse tri-state driver means having an input coupled to said start pulse, a gate coupled to said pulse stream and an output; and analog sound generation means connected to said output for generating a decaying amplitude tone initiated by said start pulse and corresponding to said pulse stream.

10. Apparatus for generating an enveloped tone signal comprising:

digital means for generating an alternating logical waveform at a selected tone frequency and a logic level start pulse for initiating the tone; and analog means responsive to the alternating logical waveform and the start pulse comprising:

storage means responsive to the start pulse for storing a charge; and switching means connected to the storage means, responsive to the alternating logical waveform for repeatedly bleeding off charge from the storage means in synchronization with the alternating logical waveform; and transducer means connected to the storage means for producing the enveloped tone signal.

11. The apparatus of claim 10 wherein said storage means comprises a capacitor coupled to the start pulse.

12. The apparatus of claim 11, further comprising a resistor and wherein the switching means is connected to the capacitor through the resistor for alternately connecting the capacitor to ground in synchronization with the alternating logical waveform.

13. The apparatus of claim 12, further comprising an operational amplifier having an input connected to the resistor.

14. Apparatus for generating an enveloped tone signal comprising:

storage means having an input terminal and responsive to a logical on signal at said input terminal for storing a charge and responsive to an alternating logical off and high impedance signal for producing an enveloped tone signal at said input terminal; and bilateral switch tone control means having a bilateral control output connected to said input terminal, a logic input terminal and a control terminal, responsive to a start signal applied to said logic input terminal and a sound signal applied to said control terminal for producing a logical on signal in response to said start signal and an alternating logical low and high impedance signal in response to said sound signal.

15. The apparatus of claim 14 further comprising click suppression means connected to said logic input terminal and said control terminal.

16. The apparatus of claim 15 wherein said click suppression means comprises an AND gate having an output connected to said logic input terminal of said bilateral device, an OR gate having an output connected to said control terminal, said AND gate and said OR gate each having a first input and a second input, each of said first inputs connected to said control terminal, and each of said second inputs connected to said logic input terminal.

17. The apparatus of claim 14 wherein said storage means comprises a capacitor.

18. The apparatus of claim 17 wherein said storage means comprises a diode in series circuit relationship with said capacitor.

19. The apparatus of claim 18 wherein said storage means comprises a resistor in parallel circuit relationship with said diode.

20. The apparatus of claim 14 further comprising amplifier means connected to said input terminal of said storage means; and speaker means connected to said amplifier means.

21. The apparatus of claim 20 in which said amplifier means comprises operational amplifier means and driver transistor means connected between said storage means and said speaker means.

22. Combined analog and digital apparatus for generating an enveloped tone signal that minimizes the number of circuit connections between the analog and digital circuit sections, comprising:

integrated circuit digital control means for generating logic level control signals including a frequency determining sound signal and a start signal and providing such signals to at most two output terminals;

analog sound generating means having at most two input terminals connected to the digital control means via said at most two output terminals and comprising storage means responsive to the start signal for storing a charge and responsive to the sound signal for discharging to produce an enveloped signal at a frequency determined by the sound signal.

* * * * *